US005524771A

United States Patent [19]

Kairi et al.

[11] Patent Number: 5,524,771

[45] Date of Patent: Jun. 11, 1996

[54] STRENGTH-GRADING OF VENEER SHEETS

[75] Inventors: Matti Kairi; Pertti Helminen, both of Lohja, Finland

[73] Assignee: Finnforest Oy, Lohja, Finland

[21] Appl. No.: 204,732

[22] Filed: Mar. 2, 1994

[30] Foreign Application Priority Data

Mar. 15, 1993 [FI] Finland ..... 931139

[51] Int. Cl.[6] ..... B07C 5/14

[52] U.S. Cl. ..... 209/518; 209/521; 209/567; 209/571

[58] Field of Search ..... 209/521, 517, 209/518, 567, 571, 572

[56] References Cited

U.S. PATENT DOCUMENTS

| | | | |
|---|---|---|---|
| 3,812,964 | 5/1974 | Woodruff | 209/571 X |
| 4,239,577 | 12/1980 | Hartman et al. . | |
| 4,610,913 | 9/1986 | Barnes . | |
| 4,739,249 | 4/1988 | Nyfors et al. . | |
| 4,905,843 | 3/1990 | Holbert . | |
| 4,915,766 | 4/1990 | Baxter . | |
| 5,002,105 | 3/1991 | Bodig . | |
| 5,006,225 | 4/1991 | Beauchemin et al. | 209/518 X |
| 5,096,765 | 3/1992 | Barnes . | |
| 5,351,833 | 10/1994 | Quick | 209/518 |

FOREIGN PATENT DOCUMENTS

| | | |
|---|---|---|
| 74816 | 10/1985 | Finland . |
| 931139 | 9/1993 | Finland . |
| 2211299 | 6/1989 | United Kingdom . |

OTHER PUBLICATIONS

Vainikainen, et al., "Radiowave Sensor for Measuring the Properties of Dielectric Sheets: Application to Veneer Moisture Content and Mass per Unit Area Measurement," IEEE Transactions on Instrumentation and Measurement, vol. IM-36, No. 4, Dec. 1987.

*Primary Examiner*—David H. Bollinger
*Attorney, Agent, or Firm*—Loeb and Loeb

[57] ABSTRACT

A method of enhancing the strength and of reducing strength variations of multi-layer wood, plywood or similar by measuring the density of the veneer sheets used in the production and by grading the veneer sheets accordingly. The density of the veneer sheets is measured in a manner known per se by using a high-frequency electromagnetic resonator (2). To build up layers of multi-layer wood, plywood or similar (12), veneer sheets confirmed to have a higher density are graded as surface sheets (13) and/or local density variations of central sheets (14) are reduced by mixing veneer sheets with various densities.

10 Claims, 1 Drawing Sheet

STRENGTH-GRADING OF VENEER SHEETS

The invention relates to a method of enhancing the strength and reducing strength variations of multi-layer wood and plywood by measuring the density of the veneer sheets used for the manufacture and by grading the veneer sheets accordingly.

It has fairly long been known that the strength of wood increases as a function of the density if the wood structure remains unchanged, i.e. the knot structure does not change substantially. In most wood implementations, it would be vital to know the wood density, since these data would allow users to select a strong wood type for sites and purposes where such strength is particularly required, and weaker types for less important or requiring purposes. The strength of wood varies considerably. There are several search results about the correlation between wood density and strength, among which we cite: Kollman, F. F. P., Wilfred, A. C. Jr.: Principles of Wood Science and Technology I Solid Wood, Springer-Verlag, Berlin Heidelberg, 1968. A rough estimate is that the strength of wood is approximately a linear function of its density, the correlation being equal to the general formula $s=a\cdot d^b$, where s is the strength (MPa), a is constant, d is the relative density and b is constant with an approximate value of 1.03. Thus, the weight of veneer sheets used for the manufacture of multi-layer wood sheets, plywood or similar varies from 2.8 to 5.6 kg/sheet, the sheet size being 1.6 m/1.93 m and the thickness 3.2 mm. The sheet density varies accordingly and so does the strength, clearly indicating significant strength variations.

It is previously known to grade veneer sheets according to density by measuring the weight of each veneer sheet with express scales and grading the sheets accordingly. This is possible because the veneer sheet has specific dimensions in view of the lathe setting and the cutters. Using weighing as a measuring method slows down manufacture on the production line markedly, and is therefore not frequently used. It has the additional drawback that only the average density of the veneer sheet can be determined, whereas it may be crucial for the use of the sheet to detect for instance individual weak points with lower density, although the average strength of the sheet would be satisfactory. In addition, this weighing method involves errors due to moisture variations, given that weighing does not distinguish the reason for the weight, i.e. whether a great weight is due to the dry substance or the water content. A second well-known method of measuring density is the use of ultrasound for the measurement. Ultrasonic devices are, however, extremely expensive investments, and involves the drawback of having to contact the ultrasonic sensor with the veneer sheet, which is a difficult operation when the veneer sheets are dried and warped. Furthermore, measurement by contact may wear the ultrasonic sensor and damage the veneer sheets.

U.S. Pat. No. 4,739,249, FI patent specification 74816 and FI patent specification 77936 describe a radio-frequency-operated electromagnetic resonator for the determination of the electric properties of a low-conductive material sheet or film or properties affecting electric properties, especially moisture. By using this sensor, a measurement arrangement can be prepared at reasonable cost, the sensor measuring moisture without touching the veneer sheet or the paper web. The measurement result is not very sensitive to the position of the web or the veneer sheet with regard to the sensor. It is also known that the basis weight, i.e. the mass per unit area, can be calculated on the basis of the measurement signals provided by this sensor.

Thus, the object of the invention is to achieve a method for increasing strength and for reducing strength variations of multi-layer wood, plywood or some other material assembled from sheet-like wooden layers or similar. A second object of the invention is a method for individual determination of the density and thus the strength of each veneer sheet or similar wooden sheet used for the manufacture of multi-layer wood, plywood or similar and for placing it in the most relevant position in view of the first object. A third object of the invention is a method having a measuring rate such that it does not substantially reduce normal production speed. A fourth object of the invention is a method which simultaneously measures the moisture of the veneer sheets, e.g. moist points, so that the impact of moisture can be reduced from the density in order to obtain the density of the wood material independently of moisture, i.e. the dry substance density, and which also yields the density distribution required for the control of the veneer sheet or similar being measured, and in which the measurement of the veneer sheet or similar preferably is carried out without touching the veneer sheet, in order to avoid damage or wear of both the veneer sheet and the sensor.

It has now been surprisingly detected that all the objects and drawbacks described above are resolved with a method which is characterized by the features defined in an embodiment of the present invention.

The main advantage of the invention is that it makes it possible to grade the strongest veneer sheets in the surface layers of multi-layer wood, plywood or similar, thus enhancing the strength of the product. At the same time, the central veneer sheets, whose strength does not affect the overall strength of the multi-layer wood or plywood significantly, may comprise veneer sheets of poorer quality, so that no waste material is produced. A second advantage of the invention is that strength variations of veneer sheets in the inner parts of the multi-layer wood, plywood or similar are balanced by rearranging the veneer sheets along the product, so that strength variations measured at various points are crucially reduced. A third advantage of the invention is that all these objects are achieved with a measuring method that does not break the material or touch the veneer sheet and is extremely rapid and reliable.

The invention is described in further detail below with reference to the accompanying drawings.

The figures show the transport path 5 of the measuring and grading device, along which veneer sheets 10 having a specific size are conveyed in direction D1 via a measuring sensor 2 known per se, which is of the type of a high-frequency electromagnetic resonator. Such a sensor has been described in patent specifications FI 77936, FI 74816 and U.S. Pat. No. 4,739,249 mentioned above. Nevertheless, such a sensor only provides the measurement distribution of the veneer sheet in the transport direction D1 of the sheets, since the sensor measures the average value in a direction transverse to this. It is preferable to use an advanced type of such a quasi-TEM transmission line resonator, in which both the central conductors inserted between the ground planes in the top **2*b* and the bottom 2*a*** of the resonator and the approximately central veneer sheet are formed as sensor elements controlled with p-i-n diodes. Such a design has been described in IEEE Transactions on Instrumentation and Measurement, Vol. IM-36, No 4, December 1987: Vainikainen, Nyfors, Fischer—"Radiowave Sensor for Measuring the Properties of Dielectric Sheets: Application to Veneer Moisture Content and Mass per Unit Area Measurement". When sensors measuring density and thus strength are discussed below in this patent application, a sensor of the type described in this publication is principally meant. Thus the structure of this sensor is not discussed in further detail in this patent application.

Figure 2:
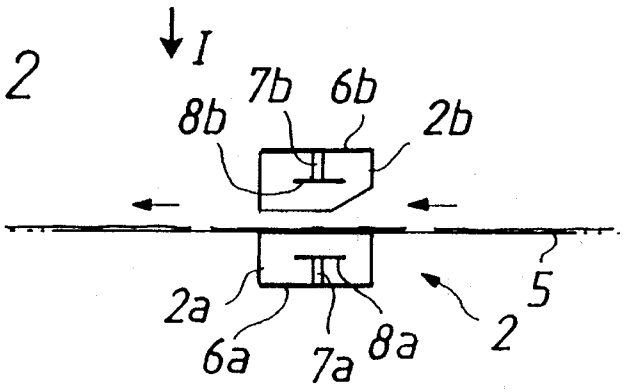
FIG. 2 shows a cross-section of the veneer sheet path in the range of the sensor in direction II of FIG. 1.

By using the measurement sensor described in the reference mentioned above, the dry total mass per unit area of a veneer sheet or a similar product can be calculated from the resonance frequency $f_r$ or Q factor provided by the sensor. As known, these depend on the real part and imaginary part of the dielectricity constant of the veneer sheet. Thus, the sensor in FIGS. 1 and 2 consists of an upper and a lower part 2*a*, 2*b*, both comprising metal ground planes 6*a*, 6*b* and central conductors 8*a*, 8*b* attached to these with plastic supports 7*a*, 7*b*. These central conductors 8, again, are divided into separate sensor units controlled by p-i-n diodes 9*a* to 9*d*, there being four of these over the width of the veneer sheet 10 in the figure. This makes it possible to make measurements at four points over the width of the veneer sheet, marked as measuring points 11 on one of the sheets. If the measuring is carried out for instance three times over the length of the motion direction D1 of the sheet, three measurement point rows are obtained in this direction, as indicated with measurement points 11. In practice, the sensor 2 comprises several parallel sensor units 9, which perform several measurements in the direction of motion of the sheet. For instance 60 measurement points on the veneer sheet 10 is a perfectly adequate number in practice. This number of measurements can be carried out in practice at least at a rate of motion of 140 m/min of the sheet, at which the measurement does not slow down production in any way. In this manner, the property distribution of each veneer sheet 10 is measured both longitudinally and transversely, and all necessary averages are of course obtained. This measuring method also makes it possible to measure the moisture content of the veneer sheet at these points, allowing a calculation of the dry substance density of the veneer sheet, i.e. the real density of the veneer sheet.

Since the dimensions of the veneer sheet are exactly determined on the basis of their lathe setting, i.e. the length, width and thickness of the veneer sheet remain constant with great accuracy, these allow an easy calculation of the density of the veneer sheet. This arrangement in particular yields the density of the veneer sheet and thus its density at various points 11, the poorest or a given number of poorest measurement values and/or various averages being usable as a control criterion for the grading and/or the rearranging.

The quasi-TEM transmission line resonator 2 described above is connected for instance to a computer 3, which in turn is connected to a grading device 4, the operation of this arrangement being described below. The construction of the grading device 4 may be of any known type, and is not described here.

Firstly, the veneer sheets having high density and thus good strength are sorted in the device 1 by means of the sensor 2, the computer 3 and the grading device 4 into surface veneer sheets 13*a*, 13*b* of the multi-layer wood 12. A buffer stock P is provided for these surface sheets 13. Veneer sheets having exceptionally low density and thus very poor strength can optionally be removed from the production as waste material R or for some other purpose of use. The remaining accepted veneer sheets are arranged as central sheets 14 in the multi-layer wood 12, especially so that the average density of coinciding subjacent central sheets 14 in the multi-layer wood 12 remains unchanged along the length of the multi-layer wood, i.e. in the assembling direction D4, on the basis of the densities and thus strengths measured. Thus, for instance, if the density and strength of veneer sheet 14*a* are very low, both the densities of veneer sheets 14*b*, 14*c* at this point must be fairly high, or one of the densities must be especially high, for the average density and thus strength of these three veneer sheets to equal the overall average density of the central veneer sheets.

Figure 1:
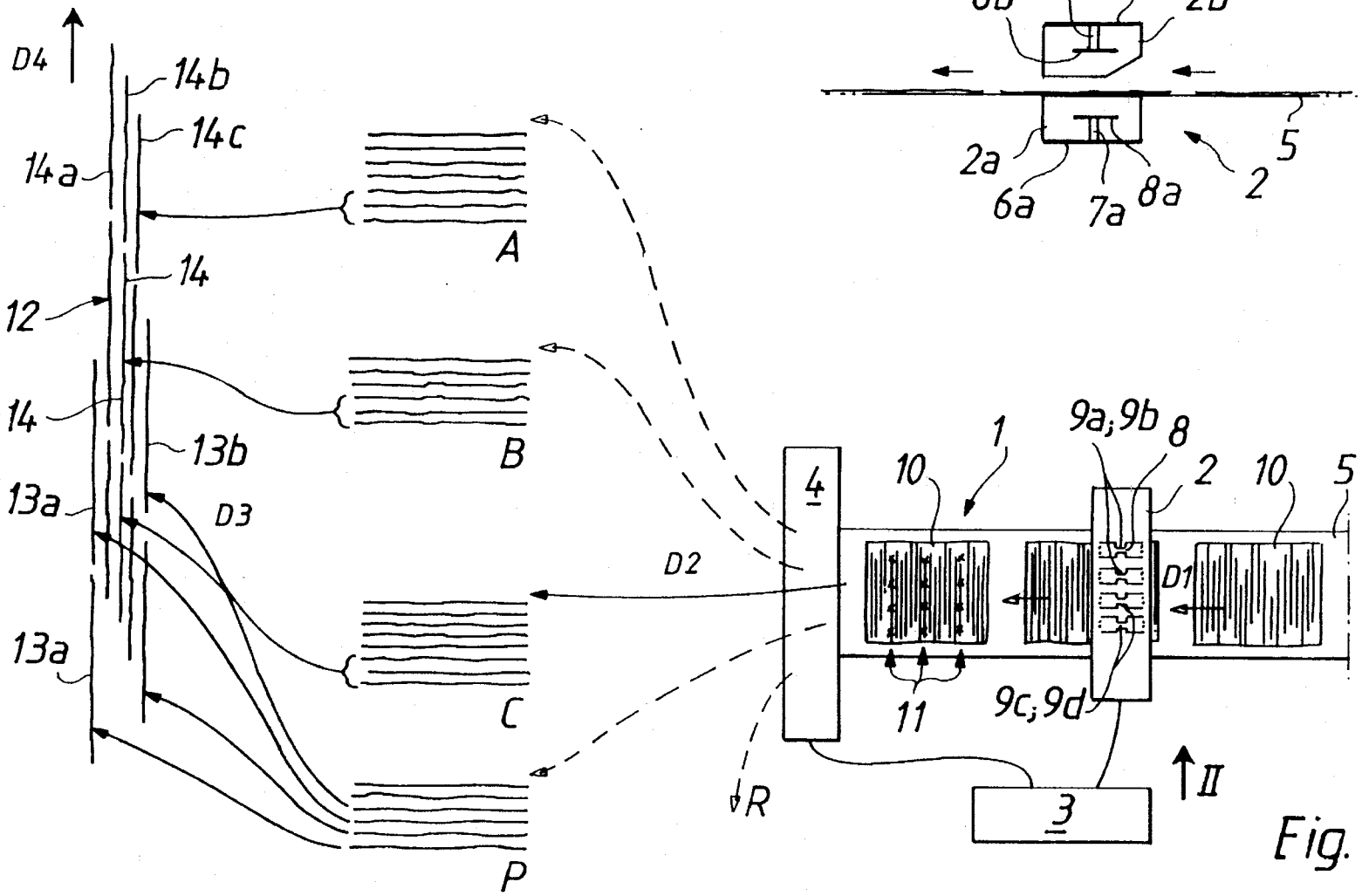
FIG. 1 is a schematic view of the production line according to the invention, comprising a sensor that measures the strength of the veneer sheet on the sheet path without breaking the material, and a system for rearranging the veneer sheets, the sheet path seen from above in direction I of FIG. 2.

According to the invention, this grading and arrangement of veneer sheets are advantageously performed in the manner illustrated in FIG. 1. Firstly, veneer sheets having sufficient density and strength to serve as surface sheets are sorted with transfer D2 by means of the sensor 2 and the sorter 4 into a pile P forming a buffer stock, from where they are transferred as transfer D3 to the assembly of multi-layer wood 12 as surface sheets 13. Sheets intended as central sheets 14 are fed out from the sorter 4 with transfer D2 into at least two, but preferably three piles A, B and C, which form the central sheet buffer stock. The veneer sheet, of which the density has been measured, passes from the path 5 with the sorter 4 to the respective pile A, B, C, where it converts the moving average of the sheets in this pile into a value closer to the overall average of all the sheets intended as central sheets 14. If for instance veneer sheets having relatively low density have just been piled in pile C by this mechanism, the veneer sheet having consecutively been detected to have relatively high density is transferred to this pile, as indicated with the full-line arrow in the figure, whereby the density remains unchanged on the average over a given distance of the pile, i.e. it remains as the average.

Especially used averages and the calculation of the moving average can be varied according to the situation in order to obtain the most advantageous result. Besides the overall average of sheet densities above, the common moving average of piles A, B, C calculated on the respective sheet number may be picked as the average aimed at by the transfer of the veneer sheets from the sorter 4 to the piles A, B, C. This operation can avoid problems in cases where the wood density varies on the average over a slightly longer period. The average of all the sheets in a pile can be used as the moving average of each pile used as a decision criterion, or the average can be calculated on sheets last fed among a given number of veneer sheets. This number may be for instance the same as the number of subjacent central sheets needed for multi-layer wood or plywood. In the example of FIG. 1, the number of veneer sheets is three. A somewhat greater or smaller number of veneer sheets can of course be used as caclulation ground for the veneer sheets. In this case, each of the veneer sheets included in the calculation can be given the same weight value in the average calculation. A second option is to use different weight coefficients in the calculation of the moving average so that the veneer sheet last arrived has the highest weight coefficient, and the earlier the veneer sheet has reached the pile A,B,C, the lower its weight coefficient. Thus, one does not necessarily have to pick a specific number, but a very great number of veneer sheets can be considered in the calculation, however with low coefficients. It is obvious that a combination of the methods for calculating the moving average can be used, in other words, the average calculation includes a given number of last sheets with the same high weight coefficient and sheets having arrived earlier with a clearly lower weight coefficient.

Other methods of calculating the moving average are also conceivable.

In practice the computer 3 carries out the calculation described, since its memory contains data about the respective pile to which a sheet has been taken, the point of location of the sheet in this pile and the density of each sheet. In other words, the average densities are calculated for each pile A,B,C, and the total average is additionally calculated, the position of the individual sheets being determined on the basis of all these data.

According to the invention, the veneer sheet piles A, B, C, P acting as a buffer stock can be used for instance by bringing the sheets to the piles from the top and from there the sheets are picked from below for the building up of multi-layer wood or plywood. The number of veneer sheets placed on top of each other as central sheets 14*a*, 14*b*, 14*c* of the multi-layer wood 12 is preferably taken from each pile. The number of vener sheets taken from the pile can of course be sligthly different. Since the veneer sheets 14*a*, 14*b*, 14*c* always overlap to some extent in the plywood and the multi-layer wood, as shown in FIG. 1, three sheets are not always simultaneously picked, but successively at short intervals, and subsequently the following pile is treated by picking the same number of veneer sheets at short intervals.

It is also possible to arrange the grading and disposition of the measured veneer sheets with some other method than the one described above in connection with FIG. 1. Thus, for instance only one buffer stock can be used, and the veneer sheets present in the stock or arriving there can be arranged on the basis of data available in the memory of the control device 3. It is also possible to assemble approximately average veneer sheets in one buffer pile and to sort light and heavy veneer sheets in a second buffer stock with a moving average corresponding to the overall average. In such arrangements, sheets usually have to be removed from and/or inserted in the sheet row or pile. Thus, technically speaking, these solutions are hardly advantageous, although the outcome is theoretically the same as the one achieved with the arrangement described above.

The measuring, grading a arranging methods described above can also be implemented in the production of products of different quality.

We claim:

1. A method for enhancing the strength and reducing the strength variation of multi-layer wood, plywood or similar product comprising (i) measuring the dry substance density of veneer sheets with a high-frequency electromagnetic resonator, (ii) grading veneer sheets with a high dry substance density as surface sheets, (iii) grading veneer sheets with lower dry substance densities as central sheets, (iv) selecting central veneer sheets with different dry substance densities, and (v) building up the layers of the multi-layer wood, plywood or similar product with said surface sheets and said selected central sheets.

2. The method according to claim 1, wherein step (i) further comprises measuring the transverse density distribution of the veneer sheets using a quasi-TEM transmission line resonator with ground planes and central conductors on either side of the veneer sheet to be measured, and p-i-n diodes formed into several separately controlled and operated sensor units distributed over the width of the veneer sheet.

3. The method according to claim 1 or 2, wherein step (i) further comprises measuring the longitudinal dry substance density distribution of the veneer sheets by measuring the dry substance density of the veneer sheet at several points over its length while the veneer sheet is moving through the resonator.

4. The method according to claim 1, wherein step (iv) further comprises arranging the central veneer sheets on the basis of the dry substance densities measured in the veneer sheets, so that the moving average of the dry substance densities of the said selected central veneer sheets remains as close as possible to the overall average of the veneer sheets used as central sheets.

5. The method according to claim 1 or 4, wherein step (iv) further comprises forming a buffer stock of veneer sheets, taking veneer sheets deviating substantially from the average dry substance density to the buffer stock, and maintaining the moving average of the dry substance density of the selected central veneer sheets close to the overall average of the dry substance density of the veneer sheets by at least one of 1) altering the order of veneer sheets, 2) removing veneer sheets, and 3) inserting veneer sheets.

6. The method according to claim 1 or 4, wherein step (iv) further comprises forming at least two veneer sheet piles acting as buffer stocks for at least the central veneer sheets, and transferring a veneer sheet of which the density has been measured to the respective veneer sheet pile in which it converts the moving average of the dry substance densities of the sheets in the pile into a value closer to the common average of all the piles.

7. The method according to claim 6, wherein step (iv) further comprises taking the veneer sheets to the top of the piles, and withdrawing veneer sheets from the bottom of the piles in a respective number equalling the number of veneer sheets selected for use in the multi-layer wood or plywood or similar product.

8. The method according to claim 6, wherein step (iv) further comprises calculating the moving average of the dry substance density in each pile for a group corresponding to the number of veneer sheets selected for use in the multi-layer wood, plywood or similar product and/or for a greater number of veneer sheets with appropriate weight coefficients.

9. The method according to claim 1, wherein step (iv) further comprises removing veneer sheets having a particularly low dry substance density according to the measurement of the density of the veneer sheets from among the veneer sheets selected.

10. A method for producing a product of predetermined quality according to the method of claim 1.

* * * * *